United States Patent [19]

Brown

[11] 4,048,536

[45] Sept. 13, 1977

[54] SHADOW MASK WITH PLURALITY OF RECESSED REGIONS EXTENDING ACROSS MASK IN TWO DIRECTIONS

[75] Inventor: Silas A. Brown, Lake Elmo, Minn.

[73] Assignee: Buckbee-Mears Company, St. Paul, Minn.

[21] Appl. No.: 668,317

[22] Filed: Mar. 18, 1976

[51] Int. Cl.[2] ..... H01J 29/07; H01J 29/08

[52] U.S. Cl. ..... 313/403; 29/25.14

[58] Field of Search ..... 313/402, 403

[56] References Cited

U.S. PATENT DOCUMENTS 3,916,243 10/1975 Brown ..... 313/403

*Primary Examiner*—Robert Segal

*Attorney, Agent, or Firm*—Jacobson and Johnson

[57] ABSTRACT

A shadow mask for a colored TV picture tube contains the conventional foraminous or translucent area formed by multiple vertical rows of miniature apertures or slits with the improvement being a pattern set of recesses which are located between the rows of slits and which extend into the margin of the mask. Because of the patterned set of recesses, doming the mask can be accurately and smoothly accomplished for insertion into the envelope of a colored television picture tube.

6 Claims, 3 Drawing Figures

SHADOW MASK WITH PLURALITY OF RECESSED REGIONS EXTENDING ACROSS MASK IN TWO DIRECTIONS

BACKGROUND OF THE INVENTION

1. Field of the Invention.

This invention relates generally to making a curved shadow mask having small openings or slits for use in colored television tubes as well as for other articles. More specifically, this is an etched mask and an etching process for producing a flat shadow mask with a plurality of apertures therein which can be molded or curved in the working region of the mask as well as the flange areas of the mask to produce a smooth, stress-free aperature mask.

2. Description of the Prior Art

In a colored television picture tube, a shadow mask or aperture mask is located between the electron guns at the rear of the tube and the phosphor dots on the faceplate at the face of the tube. Electron beams pass through the tiny openings or apertures of the shadow mask and impinge on a suitable color producing phosphor dot on the faceplate. Located in line with the openings of the shadow mask are three phosphor dots, lines or the like — one dot or line for each of the primary colors. During operation of the picture tube, the shadow mask openings are used as a guide for the electron beams. In one type of these prior art masks, the openings are relatively small and elongated. The process of making openings in an elongated shape is shown and described in a co-pending application by Frantzen and Barton, entitled "Etching process for Accurately Making Small Holes in Thick Materials", Ser. No. 487,663, filed July 11, 1974.

The present invention relates to making a mask having elongated openings therein and providing the mask with a plurality of similar recessed regions to allow for two dimensional forming of the mask to produce a smooth, continuous rounded surface even in the marginal areas of the shadow mask.

Recently, the shadow mask industry has begun using the types of shadow masks which have elongated slots or slits located in vertical lines in the face of the mask. Generally, the openings in the face of the masks have a minimum dimension which is less than the thickness of the mask material. In addition, the openings are located in vertical alignment on the face of the mask. These factors coact to make it difficult to etch a shadow mask and then form the mask into a curved mask suitable for use in a television picture tube. One of the problems encountered with forming the mask is that because the sets of openings are located in vertical alignment, the mask region between the openings ruptures easily when the mask is domed or formed into the required shape for insertion into the television picture tube.

The present invention has been found to eliminate the difficulty of forming a smooth curved surface from a sheet of flat material having a set of slot-like openings located in alignment with one another and parallel to one another. Briefly, the present invention provides a set of recesses which are not interconnected but are located in a symetric pattern throughout the margin and the face of the mask, i.e., the pattern of recesses is located in the margin and edges of the mask even though the apertures or slits are not located in the margins of the mask. It has been found that the present arrangement of recess areas allows for smoothly forming or doming of the mask in both the face region of the mask and the margin area of the mask.

The co-pending application of applicant's shadow mask construction filed September 20, 1974, U.S. Ser. No. 507,689, now U.S. Pat. No. 3,916,243, shows and describes a process for preventing rupture of the tie bars on the face of a shadow mask by use of parallel grooves or channels located between the etched slots on the mask. The present invention in contrast, provides for a pattern of recesses which extend the length of the mask and are dispersed and matched with the slot openings in the mask. The pattern of recesses extend throughout both the face and the margin of the mask. With the pattern of recesses shown and described herein, it has been found that the mask can be smoothly curved and domed into the proper shape for insertion into a television picture tube.

SUMMARY OF THE INVENTION

Briefly, the present invention comprises a patterned mask and process for etching the mask to produce a flat mask which contains a set of patterned recesses located throughout both the face of the mask and the margin of the mask so that the mask can be smoothly formed into a continuous curved mask for insertion into the glass envelope of the television picture tube. The location of the recessed regions and the arrangement provide stability to the mask as well as allowing for the doming of the mask without rupturing or bending the mask at any particular point.

DESCRIPTION OF THE PREFERRED EMBODIMENT

Figure 1:
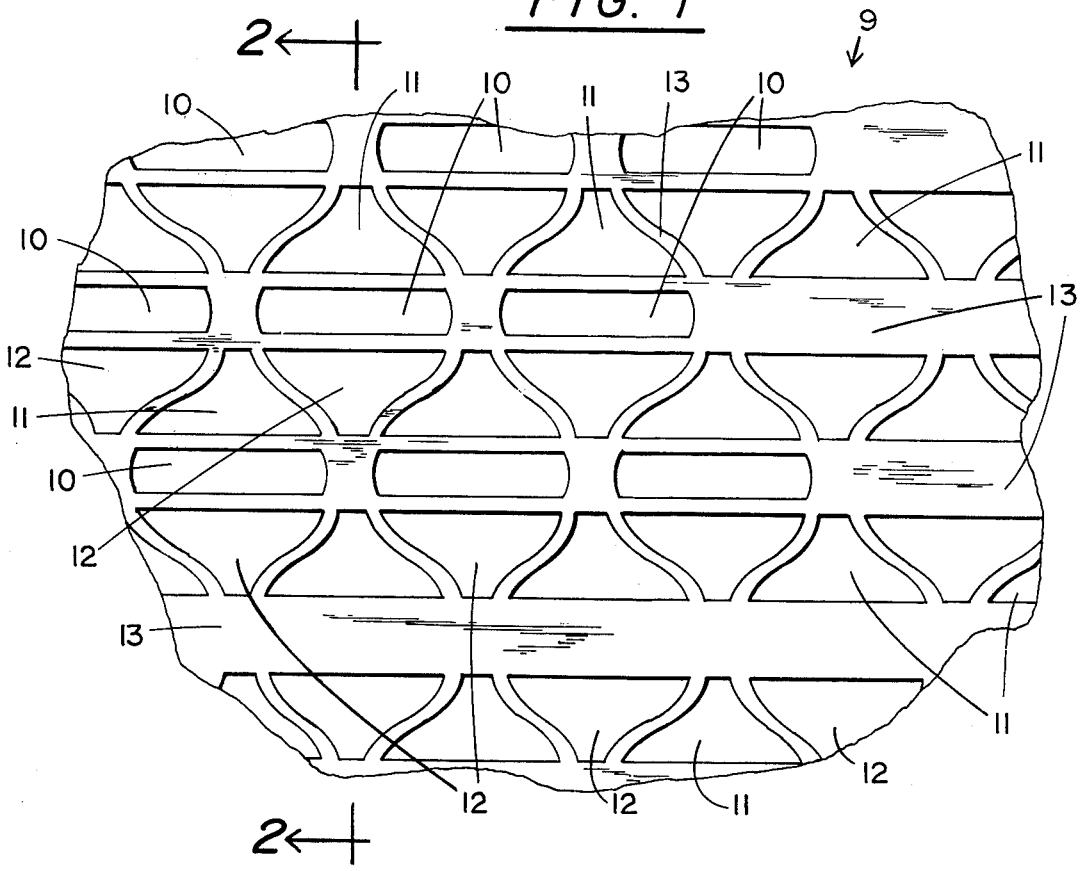
FIG. 1 is an enlarged section view of a portion of the television aperture mask.
Figure 2:
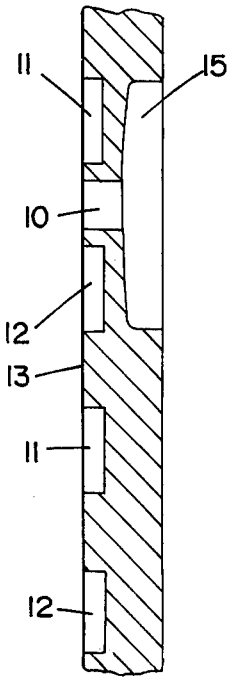
FIG. 2 is a cross-section view of a portion of the mask.
Figure 3:
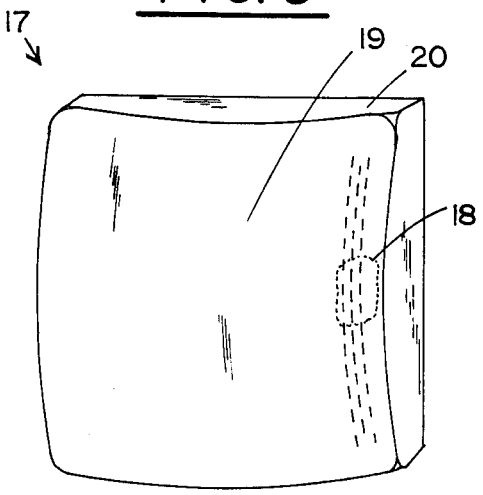
FIG. 3 is a pictorial view of a formed and domed shadow mask for insertion into the glass envelope of the television picture tube.

FIG. 1 shows an enlarged portion of an etched shadow mask with the recess regions 11 and 12 defining a set of recessed regions. Briefly, elongated apertures 10 are located in spaced relationship in mask material 9. Elongated apertures 10 are also located in end to end alignment with one another and in spaced parallel rows as can be seen in FIG. 1. A reference to FIG. 2 shows the apertures 10 as they appear in cross section. Note, located on the back side of the mask and surrounding each of the apertures 10 is an enlarged recess area 15 which has been etched so that the openings 10 could be formed in mask 9. Openings 10 having a minimum dimension which is less than the thickness of the material; i.e., the width of aperture 10 as shown in FIG. 2 is less than the thickness of mask material 9. However, the recess areas 15 which are located on the back side of the mask are not part of the present invention but were placed therein as a means for optaining the final dimensioned opening 10.

Referring to FIG. 2, reference numeral 17 designates a mask in its formed and domed shape with the lines of apertures 18 located in the center portion 19 of the mask 17; however, in margin 20 there are no openings and the mask is solid.

FIG. 2 shows a recess area 11 on one side of opening 10 and a recess area 12 located on the opposite side of opening 10. FIG. 1 and FIG. 2 show a land or surface area 13 that continues throughout the mask and is defined by recess areas 11, 12 and slots 10. Recess area 11 has an appearance similar to a side view of a suction cup with a base section larger than the top section. The identically shaped recessed areas 11 and 12 are located on opposite sides of slot 10 and are located in a symmetrical relationship with respect to opening 10. With alternate spacing of opening 10, one can form a pattern of recess regions 11 and 12 as shown in FIG. 1. The depth of the recess area 11 and 12 is sufficient so as to weaken the mask, yet not so deep so as to interfere with recesses 11 (FIG. 2) located on the back side of the mask. Approximately, 20% of the thickness of the mask is preferred for most applications.

FIG. 1 shows the pattern of recessed areas 11 and 12 continued throughout the mask and into the margin areas of the mask where there are no elongated openings therein. That is, the entire sheet of material which is used to form the mask has continuous pattern of recess area and land areas located throughout the mask. It is this continuous pattern of recesses througout the front of the mask even in areas such as the mask margin where there are no openings which has allowed applicant to make a mask which can be smoothly formed not only in the face area of the mask but the margin area of the mask without fear of rupturing the mask.

I claim:

1. An aperture mask having a plurality of openings therein for the projection of an electron beam therethrough comprising:

a sheet of metal having a front side and a back side, said sheet of metal having a plurality of openings located therein, said plurality of openings forming a plurality of rows of openings, a plurality of cavities located on the back side of said mask with a cavity located around and including each of said plurality of openings in said mask;

a plurality of recessed regions forming a pattern of recessed regions and located on the front side of said sheet of metal, said pattern of recessed regions extending across said mask in two directions so that said mask can be formed in at least two directions without rupturing said sheet of metal.

2. The invention of claim 1 wherein said recessed regions are located on opposite sides of each of said plurality of openings and form a repetitive pattern thereon.

3. The invention of claim 2 wherein said plurality of recessed regions have a base and a top with said base having a dimension greater than said top.

4. The invention of claim 3 wherein said plurality of recessed regions have a depth formed by etching sufficiently into the said sheet of metal to structurally weaken said sheet of metal and thereby allow said sheet of metal to be domed into a television aperture mask without rupturing said sheet of metal.

5. The invention of claim 4 wherein said plurality of recessed regions are located in alignment between said rows of openings.

6. The invention of claim 5 wherein said plurality of recessed regions are located in spaced parallel rows between said plurality of rows of openings.

* * * * *